US012092366B2

(12) United States Patent
Tsai et al.

(10) Patent No.: US 12,092,366 B2
(45) Date of Patent: Sep. 17, 2024

(54) WATER HEATER APPLIANCE AND METHODS FOR ANTICIPATING RECHARGE

(71) Applicant: Haier US Appliance Solutions, Inc., Wilmington, DE (US)

(72) Inventors: Craig Iung-Pei Tsai, Louisville, KY (US); Paul Goodjohn, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 77 days.

(21) Appl. No.: 17/984,503

(22) Filed: Nov. 10, 2022

(65) Prior Publication Data

US 2024/0159431 A1 May 16, 2024

(51) Int. Cl.
*F24H 15/172* (2022.01)
*F24H 15/18* (2022.01)
*F24H 15/225* (2022.01)

(52) U.S. Cl.
CPC ..... *F24H 15/18* (2022.01); *F24H 15/225* (2022.01)

(58) Field of Classification Search
None
See application file for complete search history.

(56) References Cited

U.S. PATENT DOCUMENTS

| | | | | |
|---|---|---|---|---|
| 6,936,798 | B2 | 8/2005 | Moreno | |
| 9,702,590 | B2 * | 7/2017 | Wen | F24H 15/223 |
| 10,168,073 | B2 | 1/2019 | Harbin, III et al. | |
| 10,415,851 | B2 * | 9/2019 | Watts | F24H 15/174 |
| 11,609,025 | B1 * | 3/2023 | Arrojula | F24D 19/1051 |
| 2013/0231812 | A1 | 9/2013 | Tokumochi et al. | |
| 2014/0321839 | A1 * | 10/2014 | Armstrong | F24D 17/0073 392/498 |

FOREIGN PATENT DOCUMENTS

JP 6065548 B2 1/2017

* cited by examiner

*Primary Examiner* — Gregory A Wilson
(74) *Attorney, Agent, or Firm* — Dority & Manning, P.A.

(57) ABSTRACT

A water heater appliance may include a casing, a tank, a temperature sensor, a heating system, and a controller. The controller may be in operative communication with the heating system. The controller may be configured to initiate a heating cycle. The heating cycle may include determining a future standby event and determining a contemporary depletion state from a plurality of set depletion states. The plurality of set depletion states may include a steady state and one or more depleted states. The heating cycle may further include calculating a recharge period according to a set formula corresponding to the determined contemporary depletion state and directing, prior to the future standby event, the water heater appliance to the steady state based on the recharge period.

20 Claims, 4 Drawing Sheets

WATER HEATER APPLIANCE AND METHODS FOR ANTICIPATING RECHARGE

FIELD OF THE INVENTION

The present subject matter relates generally to water heater appliances, and more particularly to methods or water heater appliances having one or more features for anticipating and efficiently prompting a recharge of heated water within the water heater appliance.

BACKGROUND OF THE INVENTION

Water heater storage tanks are used for storing and supplying hot water to residential and commercial properties. A typical residential water heater holds about fifty gallons (190 liters) of water inside a steel reservoir tank. A thermistor is used to control the temperature of the water inside the tank. Many water heaters permit a consumer to set the thermistor to a temperature between 90 and 150 degrees Fahrenheit (F) (32 to 65 degrees Celsius (C)). To prevent scalding and to save energy, consumers may set the thermistor to heat the reservoir water to a temperature below 125 degrees F. (about 52 degrees C.).

A water heater typically delivers hot water according to the thermistor temperature setting. As a consumer draws water from the water heater, the water temperature in the water heater usually drops due to cooler supply water displacing the heated water in the storage tank. As the thermistor senses that the temperature of the water inside the tank drops below thermistor's set point, power is sent to the electric resistance heating element (or a burner in a gas water heater or a heat pump in the case of a heat pump water heater). The electric elements then draw energy to heat the water inside the tank to a preset temperature level.

In spite of such typical operations, there are certain events or times that will disrupt water heating. For instance, in some locations of the United States and globally, the cost for electrical energy to heat water can depend upon the time of day Additionally or alternatively, certain regions may implement planned power restrictions (e.g., brownouts). Further additionally or alternatively, certain religious customs may restrict the heating of water at prescribed times (e.g., Sabbath in the case of Orthodox Jewish customs).

In the event(s) water heating is known or likely to be disrupted it may be useful to have a relatively large amount of heated water available. However, simply heating water in advance of a known event may be especially wasteful or bring water within the water heater appliance to an excessive temperature. Moreover, if water is heated too early, it may risk becoming cold or needing to be reheated prior to the known event.

Accordingly, it would be useful to provide a water heater or method of operation that includes steps or features for efficiently charging or recharging the water heater with heated water prior to a known disruption or event.

BRIEF DESCRIPTION OF THE INVENTION

Aspects and advantages of the invention will be set forth in part in the following description, or may be obvious from the description, or may be learned through practice of the invention.

In one exemplary aspect of the present disclosure, a water heater appliance is provided. The water heater appliance may include a casing, a tank, a temperature sensor, a heating system, and a controller. The tank may be disposed within the casing. The tank may define an inlet and an outlet. The temperature sensor may be attached to the casing in thermal communication with the tank to detect a temperature thereof. The heating system may be in thermal communication with the tank to heat water within the tank. The controller may be in operative communication with the heating system. The controller may be configured to initiate a heating cycle. The heating cycle may include determining a future standby event and determining a contemporary depletion state from a plurality of set depletion states. The plurality of set depletion states may include a steady state and one or more depleted states. The heating cycle may further include calculating a recharge period according to a set formula corresponding to the determined contemporary depletion state and directing, prior to the future standby event, the water heater appliance to the steady state based on the recharge period.

In another exemplary aspect of the present disclosure, a method of operating a water heater appliance is provided. The method may include determining a future standby event for the water heater appliance. The method may also include determining a contemporary depletion state from a plurality of set depletion states. The plurality of set depletion states may include a steady state and one or more depleted states. The method may further include calculating a recharge period according to a set formula corresponding to the determined contemporary depletion state. The method may still further include directing, prior to the future standby event, the water heater appliance to the steady state based on the recharge period.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

Figure 1:
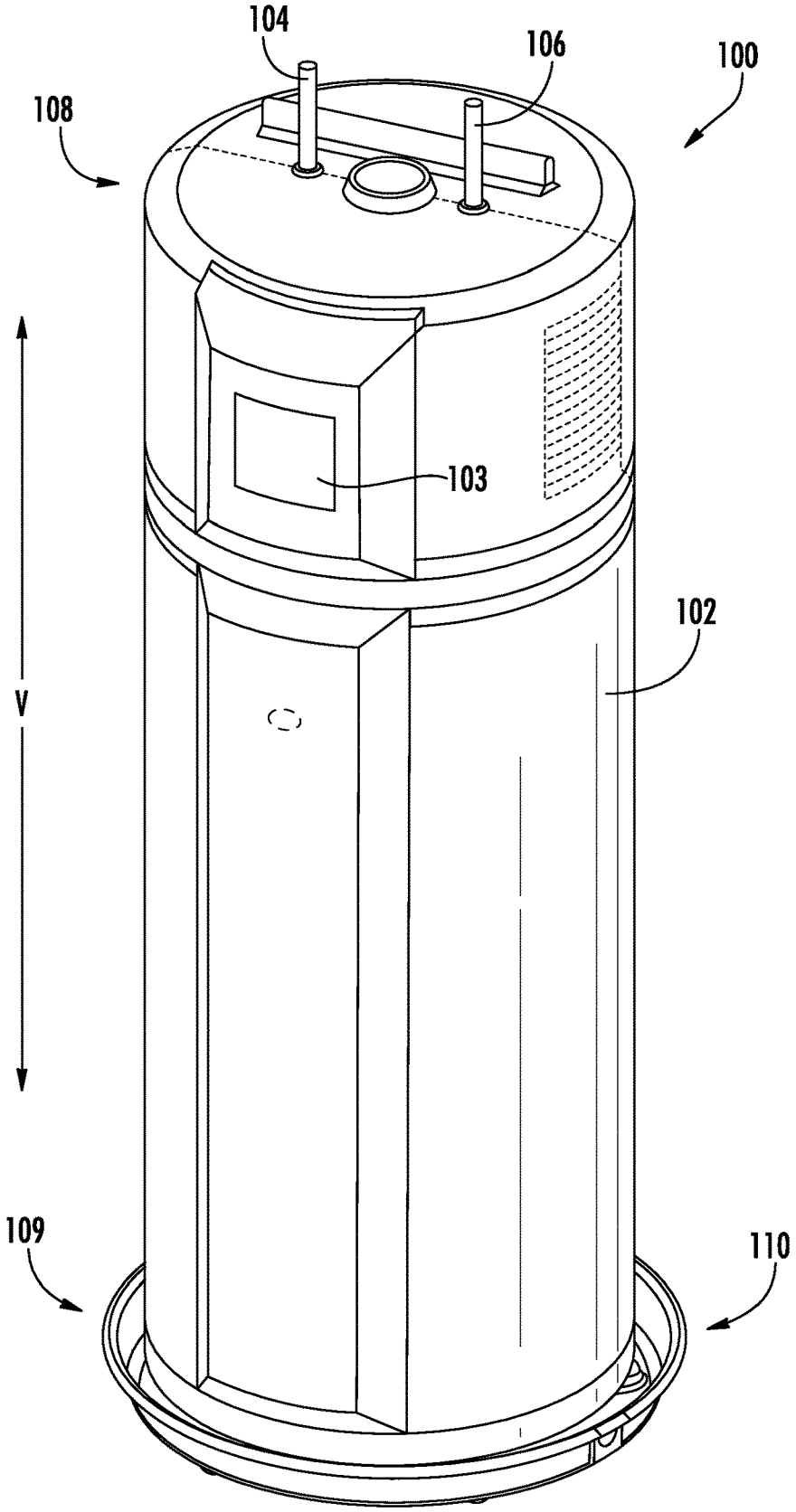
FIG. 1 provides a perspective view of a water heater appliance according to exemplary embodiments of the present disclosure.

Repeat use of reference characters in the present specification and drawings is intended to represent the same or analogous features or elements of the present invention.

DETAILED DESCRIPTION

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, the terms "first," "second," and "third" may be used interchangeably to distinguish one component from another and are not intended to signify location or importance of the individual components. The terms "includes" and "including" are intended to be inclusive in a manner similar to the term "comprising." Similarly, the term "or" is generally intended to be inclusive (i.e., "A or B" is intended to mean "A or B or both"). In addition, here and throughout the specification and claims, range limitations may be combined or interchanged. Such ranges are identified and include all the sub-ranges contained therein unless context or language indicates otherwise. For example, all ranges disclosed herein are inclusive of the endpoints, and the endpoints are independently combinable with each other. The singular forms "a," "an," and "the" include plural references unless the context clearly dictates otherwise.

Approximating language, as used herein throughout the specification and claims, may be applied to modify any quantitative representation that could permissibly vary without resulting in a change in the basic function to which it is related. Accordingly, a value modified by a term or terms, such as "generally," "about," "approximately," and "substantially," are not to be limited to the precise value specified. In at least some instances, the approximating language may correspond to the precision of an instrument for measuring the value, or the precision of the methods or machines for constructing or manufacturing the components or systems. For example, the approximating language may refer to being within a 10 percent margin (i.e., including values within ten percent greater or less than the stated value). In this regard, for example, when used in the context of an angle or direction, such terms include within ten degrees greater or less than the stated angle or direction (e.g., "generally vertical" includes forming an angle of up to ten degrees in any direction, such as, clockwise or counterclockwise, with the vertical direction V).

The word "exemplary" is used herein to mean "serving as an example, instance, or illustration." In addition, references to "an embodiment" or "one embodiment" does not necessarily refer to the same embodiment, although it may. Any implementation described herein as "exemplary" or "an embodiment" is not necessarily to be construed as preferred or advantageous over other implementations. Moreover, each example is provided by way of explanation of the invention, not limitation of the invention. In fact, it will be apparent to those skilled in the art that various modifications and variations can be made in the present invention without departing from the scope of the invention. For instance, features illustrated or described as part of one embodiment can be used with another embodiment to yield a still further embodiment. Thus, it is intended that the present invention covers such modifications and variations as come within the scope of the appended claims and their equivalents.

The terms "upstream" and "downstream" refer to the relative flow direction with respect to fluid flow in a fluid pathway. For example, "upstream" refers to the flow direction from which the fluid flows, and "downstream" refers to the flow direction to which the fluid flows.

Figure 2:
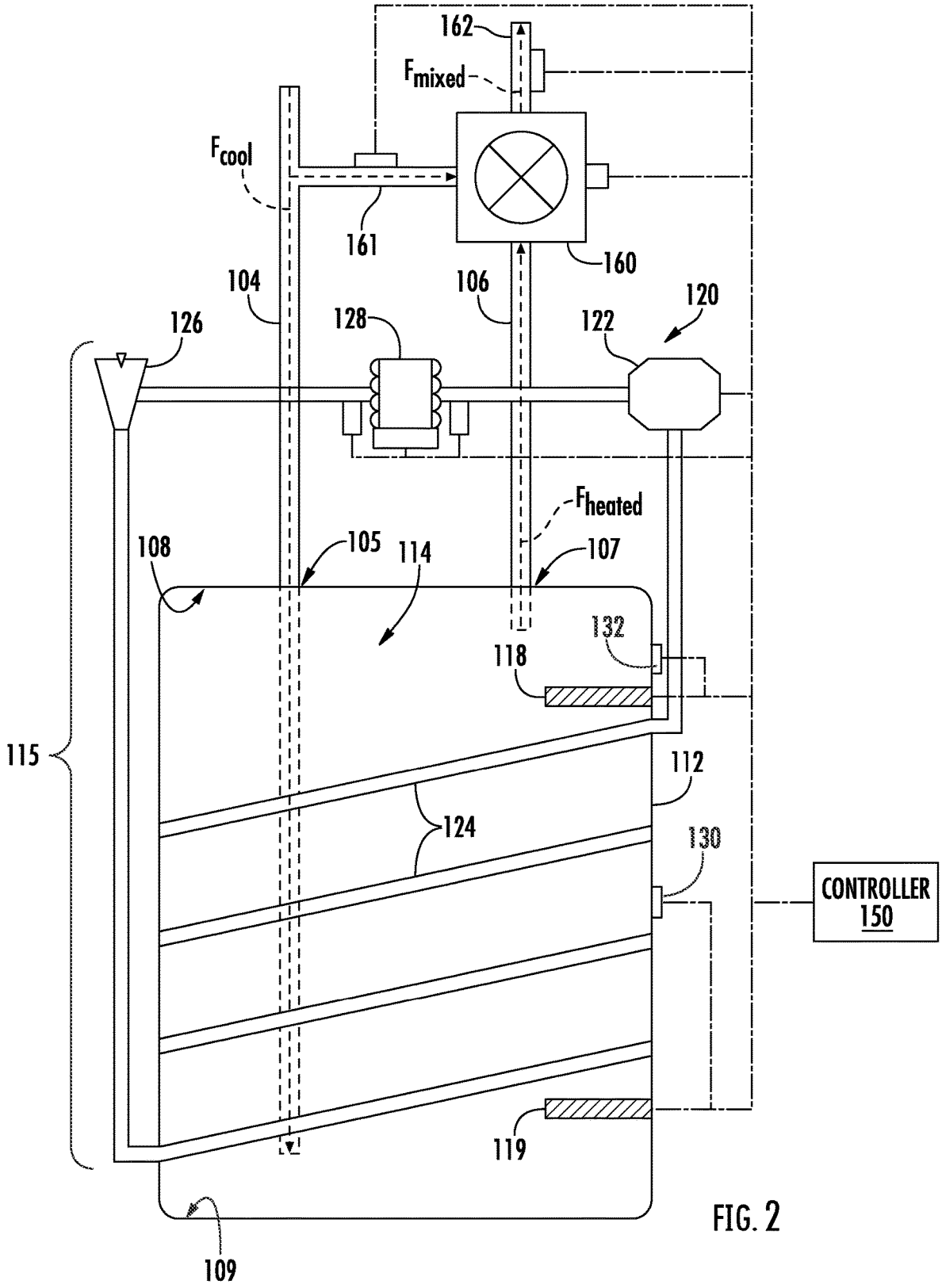
FIG. 2 provides a schematic view of certain components of the exemplary water heater appliance of FIG. 1.

Turning now to the figures, FIG. 1 provides a perspective view of a water heater appliance 100 according to an exemplary embodiment of the present subject disclosure. FIG. 2 provides schematic views of certain components of water heater appliance 100. As may be seen in FIGS. 1 and 2, water heater appliance 100 includes a casing 102 and a tank 112 mounted within casing 102. Tank 112 defines an interior volume 114 for heating water therein.

Water heater appliance 100 also includes an inlet conduit 104 and an outlet conduit 106 that are both in fluid communication with tank 112 within casing 102. As an example, cold water from a water source, such as a municipal water supply or a well, enters water heater appliance 100 through inlet conduit 104 (e.g., at an inlet 105 extending through an upper portion of tank 112). From inlet conduit 104, such cold water enters interior volume 114 of tank 112 wherein the water is heated to generate heated water. Such heated water exits water heater appliance 100 at outlet conduit 106 (e.g., supplied through an outlet 107 at an upper portion of tank 112) and, for example, is supplied to a bath, shower, sink, or any other suitable feature.

As shown, interior volume 114 of tank 112 extends between a top portion 108 and a bottom portion 109 along a vertical direction V. Thus, water heater appliance 100 is generally vertically oriented. Water heater appliance 100 can be leveled (e.g., such that casing 102 is plumb in the vertical direction V) in order to facilitate proper operation of water heater appliance 100.

In certain embodiments, water heater appliance 100 includes a control panel 103 having one or more user inputs (e.g., attached to casing 102 proximal to top portion 108). Control panel 103 may be in communication with a controller 150 (FIG. 2), as would be understood. Control panel 103 may thus receive power as directed by controller 150. Additionally or alternatively, a user of water heater appliance 100 may interact with the user inputs of control panel 103 to operate the water heater appliance 100, and user commands may be transmitted between the user inputs and controller 150 to facilitate operation of the water heater appliance 100 based on such user commands. A display may additionally be provided in the control panel 103 in communication with the controller 150. The display may, for example be a touchscreen or other text-readable display screen, or alternatively may simply be a light that can be activated and deactivated as required to provide an indication of, for example, an event or setting for water heater appliance 100.

In certain embodiments, a drain pan 110 is positioned at bottom portion 109 of water heater appliance 100 such that water heater appliance 100 sits on drain pan 110. Drain pan 110 sits beneath water heater appliance 100 along the vertical direction V (e.g., to collect water that leaks from water heater appliance 100 or water that condenses on an evaporator 128 of water heater appliance 100). It should be understood that water heater appliance 100 is provided by way of example only and that the present subject matter may be used with any suitable water heater appliance.

It should be understood that water heater appliance 100 is provided by way of example only and that the present disclosure may be used with any suitable water heater appliance.

Turning now to FIG. 2, exemplary embodiments of water heater appliance 100 include a heating system 115, such as one or more of an upper heating element 118, a lower heating element 119, or a sealed system 120 in thermal communication with the tank 112. During operation of water heater appliance 100, one or all of upper heating element 118, lower heating element 119, or sealed system 120 may thus be selectively activated to heat water within interior volume 114 of tank 112.

As shown, the exemplary embodiments of FIG. 2 include upper heating element 118, lower heating element 119, or sealed system 120. Thus, the exemplary water heater appliance 100 is commonly referred to as a "heat pump water heater appliance." Upper and lower heating elements 118 and 119 can be any suitable heating elements. For example, upper heating element 118 or lower heating element 119 may be electric heating elements, such as an electric resistance element, a microwave element, an induction element, or any other suitable heating element (including combinations thereof). Lower heating element 119 may also include or be provided as a gas burner. Moreover, it is understood that illustrated heat pump water heater appliance embodiments is merely a non-limiting example, and other water heater appliance configurations may be provided within the scope of the present disclosure (e.g., embodiments including a different heating system having more heating elements, fewer heating elements, or no sealed system).

Sealed system 120 includes a compressor 122, a condenser 124, a throttling device 126, and an evaporator 128. Condenser 124 is thermally coupled or assembled in a heat exchange relationship with tank 112 in order to heat water within interior volume 114 of tank 112 during operation of sealed system 120. In particular, condenser 124 may be a conduit coiled around and mounted to tank 112. During operation of sealed system 120, refrigerant exits evaporator 128 as a fluid in the form of a superheated vapor or high quality vapor mixture. Upon exiting evaporator 128, the refrigerant enters compressor 122 wherein the pressure and temperature of the refrigerant are increased such that the refrigerant becomes a superheated vapor. The superheated vapor from compressor 122 enters condenser 124 wherein it transfers energy to the water within tank 112 and condenses into a saturated liquid or high quality liquid vapor mixture. This high quality/saturated liquid vapor mixture exits condenser 124 and travels through throttling device 126, which is configured for regulating a flow rate of refrigerant therethrough. Upon exiting throttling device 126, the pressure and temperature of the refrigerant drop at which time the refrigerant enters evaporator 128 and the cycle repeats itself. In certain exemplary embodiments, throttling device 126 may be an electronic expansion valve (EEV).

A fan or air handler may assist with heat transfer between air about water heater appliance 100 (e.g., within casing 102) and refrigerant within evaporator 128. Air handler may be positioned within casing 102 on or adjacent evaporator 128. Thus, when activated, air handler may direct a flow of air towards or across evaporator 128, and the flow of air from air handler may assist with heating refrigerant within evaporator 128. It is understood that air handler may be any suitable type of air handler, such as an axial or centrifugal fan.

As shown, water heater appliance 100 includes one or more tank temperature sensors, such as a first temperature sensor 130 (e.g., lower temperature sensor) and a second temperature sensor 132 (e.g., upper temperature sensor). Generally, tank temperature sensors 130, 132 are configured for measuring a temperature of water within interior volume 114 of tank 112 and can be any suitable temperature sensing device (e.g., in operative communication with the controller 150). For example, one or more tank temperature sensors 130, 132 may be provided as a thermocouple, thermistor, or electromechanical temperature-dependent switch (e.g., bimetal switch).

Tank temperature sensors 130, 132 may be positioned at any suitable location within or on water heater appliance 100. For instance, one or more tank temperature sensors 130, 132 may be positioned within interior volume 114 of tank 112 or may be mounted to tank 112 outside of interior volume 114 of tank 112. When mounted to tank 112 outside of interior volume 114 of tank 112, a tank temperature sensor (e.g., first temperature sensor 130 or second temperature sensor 132) can be configured for indirectly measuring the temperature of water within interior volume 114 of tank 112. For example, tank temperature sensors 130, 132 can measure the temperature of tank 112 and correlate the temperature of tank 112 to the temperature of water within interior volume 114 of tank 112. Additionally or alternatively, one or more tank temperature sensor 130 or 132 may also be positioned at or adjacent top portion 108 of water heater appliance 100 (e.g., at or adjacent an inlet of outlet conduit 106).

In certain embodiments, first temperature sensor 130 is attached to tank 112 at a location below second temperature sensor 132. For instance, first temperature sensor 130 may be mounted above lower heating element 119, but below upper heating element 118. Additionally or alternatively, second temperature sensor 132 may be mounted above upper heating element 118. One or both of temperature sensors 130, 132 may be mounted above a midpoint of tank 112 (e.g., at upper half of tank 112).

Water heater appliance 100 further includes a power source or controller 150 that is configured for regulating operation of water heater appliance 100 (e.g., by selectively directing electrical power energy from a connected power grid). Controller 150 is in, for example, operative communication (e.g., electrical communication through one or more conductive wires/busses) with upper heating element 118, lower heating element 119, compressor 122, or tank temperature sensors 130, 132. Thus, controller 150 may selectively activate the heating system 155 (e.g., upper heating element 118, lower heating element 119, or compressor 122) in order to heat water within interior volume 114 of tank 112. As an example, controller 150 may activate/deactivate heating elements 118, 119 based on or in response to signals from temperature sensors 130, 132. Moreover, controller 150 may initiate one or more heating cycles or methods (e.g., method 300—FIG. 3—or 400—FIG. 4) to control operations of water heater appliance 100.

In some embodiments, controller 150 includes memory (e.g., non-transitive media) and one or more processing devices such as microprocessors, CPUs or the like, such as general or special purpose microprocessors operable to execute programming instructions or micro-control code associated with operation of water heater appliance 100. The memory can represent random access memory such as DRAM, or read only memory such as ROM or FLASH. The processor executes programming instructions stored in the memory. The memory can be a separate component from the processor or can be included onboard within the processor. Alternatively, controller 150 may be constructed without using a microprocessor (e.g., using a combination of discrete analog or digital logic circuitry; such as switches, amplifiers, integrators, comparators, flip-flops, AND gates, and the like) to perform control functionality instead of relying upon software.

Controller 150 may generally operate upper heating element 118, lower heating element 119, or compressor 122 in order to heat water within interior volume 114 of tank 112 (e.g., as part of a heating cycle). As an example, in certain modes of operation, a user may select or establish a requested temperature value for a target setpoint, $t_s$, for water within interior volume 114 of tank 112 (e.g., via a setpoint request prompted from a control panel or user interface of the appliance 100). Additionally or alternatively, the target setpoint $t_s$ for water within interior volume 114 of tank 112 may be set (e.g., initially) to a default value. Further additionally or alternatively, the target setpoint $t_s$ may be variably set as one or more modified temperature values (e.g., as described below).

Based upon the target setpoint $t_s$ for water within interior volume 114 of tank 112, controller 150 may selectively activate upper heating element 118, lower heating element 119, or compressor 122. For instance, a temperature range may be provided for the target setpoint $t_s$ (e.g., as it exists or is set at a given contemporaneous moment). In other words, a range (e.g., fixed or variable temperature range) may be provided that establishes a target minimum $t_{smin}$ and a target maximum $t_{smin}$ based on the target setpoint $t_s$. As would be understood, the target minimum $t_{smin}$ and the target maximum $t_{smin}$ are below and above, respectively, the target setpoint $t_s$. If the water within interior volume 114 of tank 112 falls below the target minimum $t_{smin}$, upper heating element 118, lower heating element 119, or compressor 122 may be activated to heat the water. If the water within interior volume 114 of tank 112 rises above the target maximum $t_{smax}$, upper heating element 118, lower heating element 119, or compressor 122 may be deactivated to stop heating the water.

The target setpoint $t_s$ for water within interior volume 114 of tank 112 may be any suitable temperature. For example, the target setpoint $t_s$ for water within interior volume 114 of tank 112 may be a value between 50 and 160 degrees Fahrenheit (F) (10 to 71 degrees Celsius (C)). To prevent scalding and to save energy, consumers may set the thermistor to heat the reservoir water to a temperature in a range between 100 degrees F. to 140 degrees F. (about 38 degrees C. to 60 degrees C.).

As would be understood, controller 150 (or appliance 100, generally) may include fault detection features to identify and curb heat output from the heating system 115 (e.g., heating element 118, heating element 119, or sealed system 120) in response to detecting a water temperature that is above the target setpoint $t_s$ (e.g., by a fault offset that is at least a predetermined temperature value or percentage). For instance, the fault detection features may identify a fault condition in response to detecting a water temperature that is at least 8 degrees F. (about 4 degrees C.) greater than the contemporaneous target setpoint $t_s$. Generally, such features may issue a fault notification (e.g., at the control panel 103) in response to identifying a fault condition. Optionally, such features may halt or otherwise restrict heat output from the heating system 115 in response to identifying a fault condition.

In optional embodiments water heater appliance 100 includes a mixing valve 160 and a mixed water outlet conduit 162. Mixing valve 160 may be in fluid communication with inlet conduit 104 via a bypass conduit 161, tank 112, and mixed water outlet conduit 162. As would be understood, mixing valve 160 may be configured for selectively directing water from inlet conduit 104 and tank 112 into mixed water outlet conduit 162 in order to regulate a temperature of water within mixed water outlet conduit 162. Mixing valve 160 may be positioned or disposed within casing 102 of water heater appliance 100 (e.g., such that mixing valve 160 is integrated within water heater appliance 100).

Figure 3:
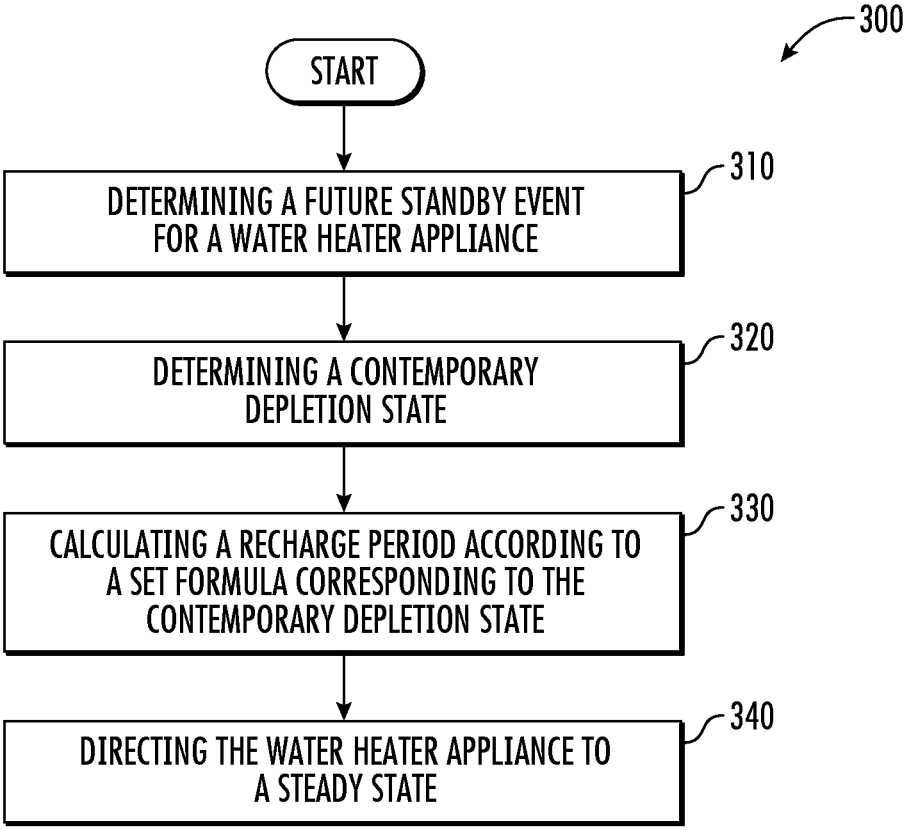
FIG. 3 provides a flow chart illustrating a method of operating a water heater appliance according to exemplary embodiments of the present disclosure.
Figure 4:
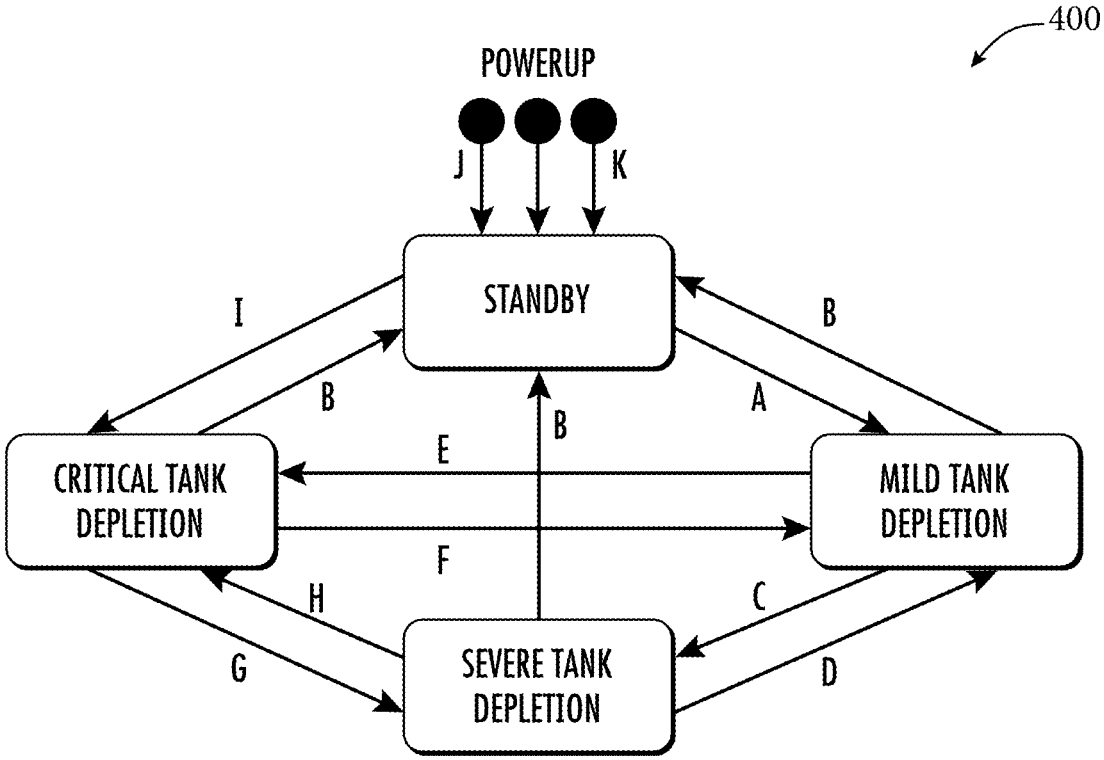
FIG. 4 provides a chart illustrating steps for determining a depletion state of a water heater appliance according to exemplary embodiments of the present disclosure.

Turning now to FIGS. 3 and 4, flow diagrams are provided of methods 300 and 400 according to an exemplary embodiments of the present disclosure. Generally, the methods 300 and 400 provide for controlling and operating a water heater appliance, such as water heater appliance 100 (FIGS. 1 and 2) (e.g., according to a heating cycle). For instance, methods 300 and 400 may provide for directing operations at one or more of control panel 103, upper heating element 118, lower heating element 119, compressor 122, mixing valve 160, as well as any other features of a suitable water appliance. The methods 300 and 400 may be performed, for instance, by the controller 150. As described above, the controller 150 may be in operative communication with control panel 103, upper heating element 118, lower heating element 119, compressor 122, mixing valve 160, or temperature sensor(s) 130, 132. Controller 150 may send signals to and receive signals from one or more of control panel 103, upper heating element 118, lower heating element 119, compressor 122, mixing valve 160, or temperature sensor(s) 130, 132. Controller 150 may further be in communication with other suitable components of the appliance 100 to facilitate operation of the water heater appliance 100 generally.

FIGS. 3 and 4 depict steps performed in a particular order for purpose of illustration and discussion. Those of ordinary skill in the art, using the disclosures provided herein, will understand that (except as otherwise indicated) methods 300 and 400 are not mutually exclusive. Moreover, the steps of the methods 300 and 400 can be modified, adapted, rearranged, omitted, interchanged, or expanded in various ways without deviating from the scope of the present disclosure.

Advantageously, methods in accordance with the present disclosure may lead to efficiently charging or recharging the water heater with heated water prior to a known disruption or event (e.g., standby event). Additionally or alternatively, such methods may provide for system-efficient data handling and processing (e.g., at the controller of the water heater appliance to estimate a recharge time).

Turning especially to FIG. 3, at 310, the method 300 includes determining a future standby event. In other words, it may be determined that a standby event in which power or heating actions will be limited (e.g., unavailable) is expected at or by a specific point in time. Such a standby event may be, for example, programmed within the memory of the appliance (e.g., according to a set calendar), manually prompted by a user (e.g., at the control panel or user interface), or based on a data signal received from a connected utility company (e.g., to indicate a programmed brown out), as would be understood. Thus, the determined future standby event may not be impending, by being anticipated to occur at least several minutes or more in the future (e.g., as measured from the time of determination).

At 320, the method 300 includes determining a contemporary depletion state from a plurality of set depletion states. Generally, the depletion state of the water heater may indicate or be contingent on the relative amount of heated water (e.g., water heated to a programmed setpoint temperature) within the tank of the water heater appliance at a given moment. Specifically, the plurality of set depletion states may include a steady state in which the tank is substantially "full" of heated water (e.g., such that, at capacity, substantially all of the water within the water heater appliance is heated or otherwise within a set range from the setpoint temperature). Moreover, the set depletion states may include one or more depleted states in which the tank is less than full of heated water. As an example, the depleted states may include a first (e.g., mild) depleted stated having less heated water than the steady state. As an additional or alternative example, the depleted states may include a second (e.g., severe) depleted stated having less heated water than the first depleted state. As another additional or alternative example, the depleted states may include a third (e.g., critical) depleted stated having less heated water than the second depleted state.

The depletion state at a given or current moment (e.g., contemporary depletion state) may be based on one or more detected temperature values (e.g., upper or lower temperature detected at a corresponding temperature sensor). For instance, the detected temperature(s) may be used with a provided chart, graph, table, or formula to determine what depletion state corresponds to the detected temperature(s). Additionally or alternatively, the depletion state at a given or current moment may be based on a previous depletion state. Thus, a previously determined depletion state (e.g., depletion state immediately prior to contemporary depletion state) may be used to determine the contemporary depletion state. For instance, the depletion state of the water heater appliance may be continuously or repeatedly determined or tracked. Thus, the appliance may be able to reference or look up what depletion state the tank has been in (e.g., prior to expiration of a set interval, a water draw event, or a heating event in which one or more portions of the heating system are activated to heat water within the tank). In some such embodiments, 320 includes detecting a contemporary temperature or temperatures from the corresponding temperature sensor(s) (e.g., as is generally understood) and referencing a previous depletion state determination, and determining the contemporary depletion state based on the contemporary temperature(s) and the determined previous depletion state (e.g., using a provided chart, graph, table, or formula that is configured to use the contemporary temperature(s) and the determined previous depletion state as inputs).

At 330, the method 300 includes calculating a recharge period according to a set formula corresponding to the determined contemporary depletion state. In other words, 330 may calculate the time needed to reach the steady state from the determined contemporary depletion state. Optionally, the set formula may be a function of the contemporary lower temperature (T1) and the contemporary upper temperature (T2) detected at the lower and upper temperature sensors, respectively.

In some embodiments, the set formula depends on the depletion state. One or more of the depletion states may provide a different or discrete recharge formula to be used with or as the set formula (e.g., based on what depletion state the contemporaneous depletion state is determined to be). Each depletion state may have its own recharge formula. Thus, a discrete recharge formula for the set formula may correspond to each depletion state of the plurality of set depletion states. In turn, 330 may include selecting the set formula corresponding to the contemporary depletion state. Moreover, the formula used for the calculation at 330 may vary based on the contemporary depletion state.

In optional embodiments, a different heating rate is output or set for one or more (e.g., each) of the depleted states. In other words, the heat provided by the heating system to heat the tank may vary based on the depletion state that the water heater appliance is in at a given moment. Thus, one or more of the depleted states may have a different corresponding heat output or heating scheme (i.e., portions of heating system that are activated to heat water or the duty cycle or duration for which certain portions are activated). For instance, the heating scheme at or coming from the severe depleted state may be different (e.g., activate different heating elements or have a greater heat output at certain portions of the tank) than the heating scheme at or coming from the mild depleted state; the heating scheme at or coming from the critical depleted state may be different (e.g., activate different heating elements or have a greater heat output at certain portions of the tank) than the heating scheme at or coming from the severe depleted state. Notably, the tank may be efficiently heated while ensuring the water is driven to an excessive temperature. Moreover, the set formula may be based on the heating rate of the determined contemporary depletion state. For instance, separate heat outputs Hmild, Hsevere, and Hcritical may be provided for heat output of the heating system at the mild, severe, and critical depleted states, respectively.

In additional or alternative embodiments, a different heating rate is output or set for one or more (e.g., each) user-selected modes (e.g., heat pump mode, hybrid heat-pump+heating element mode, high demand mode, vacation mode, etc.). In other words, the heat provided by the heating system to heat the tank may vary based on the user-selected mode that the water heater appliance is operating in at a given moment. Thus, the portions of heating system that are activated to heat water or the duty cycle or duration for which portions are activated (i.e., heating scheme) may be contingent on or limited by the mode selected by a user, as would be understood. Moreover, the set formula may be based on the heating rate of the current user-selected mode.

In further additional or alternative embodiments, the set formula accounts for time within each depletion state that the tank enters before reaching the steady state. For instance, the set formula may be configured to calculate a discrete time period within each depletion state leading up to the steady state from the contemporary depletion state. Thus, the set formula for time (tss) may be provided as the summation of sub-formulas for estimated time within the mild depleted state (tms), severe depleted state (tvm), or critical depleted state (tcv). Optionally, the sub-formulas may depend on the presence of one or more preceding depleted state. For instance, if going from the mild to the steady state, tss may equal tms1; if going from the severe state to the steady state, tss may equal (tvm2+tms2); and if going from the critical state to the steady state, tss may equal (tcv3+tvm3+tms3).

In still further additional or alternative embodiments, the set formula (or portions thereof) accounts for temperature changes within different levels of the tank. In other words, the set formula may weight certain factors based on the tank volume or arrangement. The volume of the tank (Vtotal) may be the summation multiple different portions of the tank. For instance, the volume of the tank may be provided as $$V\text{total}=V\text{top}+V\text{mid}+V\text{bot}$$

wherein:

- Vtop is volume of water within the tank (e.g., in gallons) above upper temperature sensor detecting T2,
- Vbot is volume of water within the tank below lower temperature sensor detecting T1, and
- Vmid is volume of water within the tank between the upper and lower temperature sensors.

For the sake of illustration, examples of the set formula (tss) being based on the previous depleted state, detected upper and lower temperatures, and variable heat outputs, and accounting for time within each depleted state are provided below. It is noted that such examples are merely for illustrative purposes and do not otherwise limit the scope of the present disclosure.

$$tss=tms1$$

$$tms1=Hmild*[(TankSetpoint-T2)*Vtop+(TankSetpoint-(T2*0.333+T1*0.667))*Vmid+(TankSetpoint-T1)*Vbot] \quad \text{[Equation 1]}$$

wherein:

TankSetpoint is a predetermined setpoint temperature for the tank,

T1 is temperature value detected at the lower temperature sensor,

T2 is temperature value detected at the upper temperature sensor,

Hmild is the heat output of the heating system in the mild depleted state, and

Vmid is volume of water within the tank between the upper and lower temperature sensors.

$$tss=tvm2+tms2$$

$$tvm2=Hsevere*[(Tsm-T2s)*Vtop+(Tsm-(T2*0.333+T1*0.667))*Vmid+(Tsm-T1)*Vbot]$$

$$tms1=Hmild*[(TankSetpoint-T2)*Vtop+(TankSetpoint-(T2*0.333+T1*0.667))*Vmid+(TankSetpoint-T1)*Vbot] \quad \text{[Equation 2]}$$

wherein:

TankSetpoint is a predetermined setpoint temperature for the tank,

T1 is temperature value detected at the lower temperature sensor,

T2 is temperature value detected at the upper temperature sensor,

Tsm is a user tank setpoint reduced by a severe offset value,

If T2>Tsm, T2s=Tsm,

If T2≤Tsm, T2s=T2,

Hsevere is the heat output of the heating system in the severe depleted state,

Hmild is the heat output of the heating system in the mild depleted state,

Vtop is volume of water within the tank above upper temperature sensor detecting T2, Vbot is volume of water within the tank below lower temperature sensor detecting T1, and Vmid is volume of water within the tank between the upper and lower temperature sensors.

$$tss=tcv3+tvm3+tms3$$

$$tvm3=Hcritical*[(Tcs-T2)*Vtop]$$

$$tvm3=Hsevere*[(Tsm-(T2*0.333+T1*0.667))*Vmid+(Tsm-T1)*Vbot]$$

$$tms3=Hmild*[(TankSetpoint-T2)*Vtop+(TankSetpoint-(T2*0.333+T1*0.667))*Vmid+(TankSetpoint-T1)*Vbot] \quad \text{[Equation 3]}$$

wherein:

TankSetpoint is a predetermined setpoint temperature for the tank,

T1 is temperature value detected at the lower temperature sensor,

T2 is temperature value detected at the upper temperature sensor,

Tcs is a user tank setpoint reduced by a critical offset value,

Tsm is a user tank setpoint reduced by a severe offset value,

If T2>Tsm, T2s=Tsm,

If T2≤Tsm, T2s=T2,

Hsevere is the heat output of the heating system in the severe depleted state,

Hmild is the heat output of the heating system in the mild depleted state,

Vtop is volume of water within the tank above upper temperature sensor detecting T2, Vbot is volume of water within the tank below lower temperature sensor detecting T1, and Vmid is volume of water within the tank between the upper and lower temperature sensors.

At 340, the method 300 includes directing, prior to the future standby event, the water heater appliance to the steady state based on the recharge period. For instance, it may be determined that the calculated recharge period is within a predetermined interval (e.g., amount of time) from the future standby event. Moreover, one or more portions of the heating system may be activated in response to the same. As noted above, the heating scheme of the heating system may being variable and based on one or more (e.g., each of the) depletion states of the plurality of set depletion states or the user-selected mode.

Following 340, or in tandem therewith, and as the heating system heats the tank or water continues to be drawn from the tank, new determinations of the depletion state or calculations of a recharge time may be made. In other words, certain steps, such as 320 and 330 may be repeated, as would be understood in light of the present disclosure. Moreover, step 340 (e.g., the active heating scheme of the heating system) may be updated, as would also be understood in light of the present disclosure.

Turning now to FIG. 4, a chart illustrating an exemplary method 400 for determining a depletion state is provided. Such a method (or portions thereof) may be optionally used as or as part of 320 (FIG. 3). For instance, the method 400 may run continuously during active operation of the water heater appliance (e.g., prior to 310) and, thus, a contemporary depletion state may be generally known at any instantaneous point while the water heater appliance. As shown, the method 400 may generally be prompted by a powerup event (e.g., initial activation of the water heater appliance), or another suitable event, such as (J) a new demand signal or (K) expiration of a vacation or extended absence mode, as would be understood.

At (A), a depletion event may occur to reduce the depletion state from the standby state to a first (e.g., mild) depleted state. As would be understood, the depletion event may be prompted or indicated by a water draw event drawing water from the tank. Additionally or alternatively, a determination may be made that water within the tank (e.g., upper temperature, T2, as measured or detected at an upper temperature sensor; or lower temperature, T1, as measured or detected at a lower temperature sensor) has fallen below a tank setpoint, TankSetpoint (or below a set amount from the TankSetpoint that corresponds to a particular temperature sensor).

At (B), the tank may generally be recovered or recharged to the steady state. For instance, the heating system may be activated to heat water within the tank to TankSetpoint (e.g., as detected by T2 and T1). The activation of heating system may be based on a user selected mode (e.g., heat pump mode, hybrid heat-pump+heating element mode, high demand mode, vacation mode, etc.). Thus, the heating scheme may be contingent on or limited by the mode selected by a user, as would be understood. Additionally or alternatively, activation of heating system may be based on the depletion state on the tank. Thus, one or more of the depleted states may have a different corresponding heating scheme. For instance, the heating scheme at or coming from the severe depleted state may be different (e.g., activate different heating elements or have a greater heat output at certain portions of the tank) than the heating scheme at or coming from the mild depleted state; the heating scheme at or coming from the critical depleted state may be different (e.g., activate different heating elements or have a greater heat output at certain portions of the tank) than the heating scheme at or coming from the severe depleted state. Notably, the tank may be efficiently heated while ensuring the water is driven to an excessive temperature.

At (C), coming from the mild depleted state, the depletion event may further reduce the depletion state to a second (e.g., severe) depleted state. Knowing or referencing the mild depleted state as the previous depletion state, a determination may be made that water within the tank has fallen below one or more setpoints (e.g., the same or different setpoints and amounts as (A)). For instance, a determination may be made that T2 is below (i.e., less than) a TankSetpoint by a set amount AND T1 is less than a programmed severe threshold. Optionally, a "large draw" flag may be stored (e.g., temporarily).

At (D), coming from the severe depleted state, the tank may heat (e.g., as directed by the heating system and corresponding heating scheme) to the mild depleted state. Knowing or referencing the severe depleted state as the previous depletion state, a determination may be made that water within the tank has risen to or above one or more setpoints. For instance, a determination may be made that T1 is greater than or equal to a programmed mild threshold. Optionally, any "large draw" flag may be cleared or deleted.

At (E), coming from the mild depleted state, the depletion event (e.g., the same or new depletion even) may further reduce the depletion state to a third (e.g., critical) depleted state. Knowing or referencing the mild depleted state as the previous depletion state, a determination may be made that water within the tank has fallen below one or more setpoints (e.g., different setpoints than (C)). For instance, a determination may be made that T2 is less than a critical threshold or less than TankSetpoint by a critical amount.

At (F), coming from the critical depleted state, the tank may heat (e.g., as directed by the heating system and corresponding heating scheme) to the mild depleted state. Knowing or referencing the critical depleted state as the previous depletion state, a determination may be made that water within the tank has risen to or above one or more setpoints. For instance, a determination may be made that T2 is greater than or equal to a programmed recovery threshold (e.g., corresponding to T2) or is with a set recovery amount from TankSetpoint. Optionally, the determination at (F) may require confirming an absence of any stored "large draw" flag.

At (G), coming from the critical depleted state, the tank may heat (e.g., as directed by the heating system and corresponding heating scheme) to the severe depleted state. Knowing or referencing the critical depleted state as the previous depletion state, a determination may be made that water within the tank has risen to or above one or more setpoints. For instance, a determination may be made that T2 is greater than or equal to a programmed recovery threshold (e.g., corresponding to T2) or is with a set recovery amount from TankSetpoint. Optionally, the determination at (F) may require confirming a presence of a stored "large draw" flag.

At (H), coming from the severe depleted state, the depletion event (e.g., the same or new depletion even) may further reduce the depletion state to the critical depleted state. Knowing or referencing the severe depleted state as the previous depletion state, a determination may be made that water within the tank has fallen below one or more setpoints (e.g., different setpoints than (C)). For instance, a determination may be made that T2 is less than a critical threshold or less than TankSetpoint by a critical amount.

At (I), coming from the steady state, the depletion event (e.g., the same or new depletion even) may reduce the depletion state rapidly to the critical depleted state. Knowing or referencing the severe depleted state as the previous depletion state, a determination may be made that water within the tank has fallen below one or more setpoints (e.g., different setpoints than (C)). For instance, a determination may be made that T2 is less than a critical threshold or less than TankSetpoint by a critical amount.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A water heater appliance comprising:

a casing;

a tank disposed within the casing, the tank defining an inlet and an outlet;

a temperature sensor attached to the casing in thermal communication with the tank to detect a temperature thereof;

a heating system in thermal communication with the tank to heat water within the tank; and a controller in operative communication with the heating system, the controller being configured to initiate a heating cycle, the heating cycle comprising determining a future standby event, the future standby event being a standby event that is anticipated to occur at a future time, determining a contemporary depletion state from a plurality of set depletion states, the plurality of set depletion states comprising a steady state and one or more depleted states, calculating a recharge period according to a set formula corresponding to the determined contemporary depletion state, and directing, prior to the future time at which the future standby event is anticipated to occur, the water heater appliance to the steady state based on the recharge period.

2. The water heater appliance of claim 1, wherein the one or more depleted states comprises a first depleted state having less heated water than the steady state, and a second depleted state having less heated water than the first depleted state.

3. The water heater appliance of claim 1, wherein determining the contemporary depletion state comprises detecting a contemporary temperature from the temperature sensor, referencing a previous depletion state determination, and determining the contemporary depletion state based on the contemporary temperature and the determined previous depletion state.

4. The water heater appliance of claim 1, wherein the temperature sensor comprises a first temperature sensor attached to the casing in thermal communication with the tank to detect a lower temperature thereof, and a second temperature sensor attached to the casing above the first temperature sensor in thermal communication with the tank to detect an upper temperature thereof.

5. The water heater appliance of claim 4, wherein the set formula is a function of the lower temperature and the upper temperature.

6. The water heater appliance of claim 1, wherein the set formula is configured to calculate a discrete time period within each depletion state leading up to the steady state from the contemporary depletion state.

7. The water heater appliance of claim 1, wherein a discrete recharge formula for the set formula corresponds to each depletion state of the plurality of set depletion states.

8. The water heater appliance of claim 1, wherein the set formula is based on a heating rate of the determined contemporary depletion state.

9. The water heater appliance of claim 1, wherein directing the water heater appliance to the steady state comprises activating the heating system according to a predetermined heating scheme, the predetermined heating scheme being variable and based on each depletion state of the plurality of set depletion states.

10. A method of operating a water heater appliance, the method comprising:

determining a future standby event for the water heater appliance, the future standby event being a standby event that is anticipated to occur at a future time;

determining a contemporary depletion state from a plurality of set depletion states, the plurality of set depletion states comprising a steady state and one or more depleted states;

calculating a recharge period according to a set formula corresponding to the determined contemporary depletion state; and directing, prior to the future time at which the future standby event is anticipated to occur, the water heater appliance to the steady state based on the recharge period.

11. The method of claim 10, wherein the one or more depleted states comprises a first depleted state having less heated water than the steady state, and a second depleted state having less heated water than the first depleted state.

12. The method of claim 10, wherein determining the contemporary depletion state comprises detecting a contemporary temperature from a temperature sensor, referencing a previous depletion state determination, and determining the contemporary depletion state based on the contemporary temperature and the determined previous depletion state.

13. The method of claim 10, wherein the water heater appliance comprises a first temperature sensor attached to a casing in thermal communication with a tank to detect a lower temperature thereof, and a second temperature sensor attached to the casing above the first temperature sensor in thermal communication with the tank to detect an upper temperature thereof.

14. The method of claim 13, wherein the set formula is a function of the lower temperature and the upper temperature.

15. The method of claim 10, wherein the set formula is configured to calculate a discrete time period within each depletion state leading up to the steady state from the contemporary depletion state.

16. The method of claim 10, wherein a discrete recharge formula for the set formula corresponds to each depletion state of the plurality of set depletion states.

17. The method of claim 10, wherein the set formula is based on a heating rate of the determined contemporary depletion state.

18. The method of claim 10, wherein directing the water heater appliance to the steady state comprises activating a heating system according to a predetermined heating scheme, the predetermined heating scheme being variable and based on each depletion state of the plurality of set depletion states.

19. A water heater appliance comprising:

a casing;

a tank disposed within the casing, the tank defining an inlet and an outlet;

a first temperature sensor attached to the casing in thermal communication with the tank to detect a lower temperature thereof;

a second temperature sensor attached to the casing above the first temperature sensor in thermal communication with the tank to detect an upper temperature thereof, a heating system in thermal communication with the tank to heat water within the tank; and a controller in operative communication with the heating system, the controller being configured to initiate a heating cycle, the heating cycle comprising determining a future standby event, the future standby event being a standby event that is anticipated to occur at a future time, determining a contemporary depletion state from a plurality of set depletion states, the plurality of set depletion states comprising a steady state and one or more depleted states, determining the contemporary depletion state comprising detecting a contemporary temperature from the temperature sensor, referencing a previous depletion state determination, and determining the contemporary depletion state based on the contemporary temperature and the determined previous depletion state, calculating a recharge period according to a set formula corresponding to the determined contemporary depletion state, the set formula being a function of the lower temperature and the upper temperature and based on a heating rate of the determined contemporary depletion state, and directing, prior to the future time at which the future standby event is anticipated to occur, the water heater appliance to the steady state based on the recharge period.

20. The water heater appliance of claim 19, wherein the set formula is configured to calculate a discrete time period within each depletion state leading up to the steady state from the contemporary depletion state.

* * * * *